United States Patent [19]

Just

[11] 4,453,394

[45] Jun. 12, 1984

[54] SHEET METAL CLAMPING APPARATUS

[75] Inventor: Wilfried Just, Duisburg, Fed. Rep. of Germany

[73] Assignee: Mannesmann Aktiengesellschaft, Dusseldorf, Fed. Rep. of Germany

[21] Appl. No.: 364,885

[22] Filed: Apr. 2, 1982

[30] Foreign Application Priority Data

Apr. 18, 1981 [DE] Fed. Rep. of Germany ..... 3115819

[51] Int. Cl.[3] ..... B21D 11/02

[52] U.S. Cl. ..... 72/302; 72/311

[58] Field of Search ..... 72/302, 301, 295, 311, 72/378, 377, 290, 422; 269/234; 254/29 A, 106

[56] References Cited

U.S. PATENT DOCUMENTS 3,349,598 10/1967 Pollak ..... 72/302

3,540,257 11/1970 Hertl ..... 72/302

3,685,333 8/1972 Priebe ..... 72/302

FOREIGN PATENT DOCUMENTS 1602467 5/1970 Fed. Rep. of Germany .

1811255 6/1970 Fed. Rep. of Germany .

243516 12/1925 United Kingdom ..... 72/302

512830 5/1976 U.S.S.R. ..... 72/311

*Primary Examiner*—Daniel C. Crane

*Attorney, Agent, or Firm*—Mandeville and Schweitzer

[57] ABSTRACT

A clamping apparatus for a metal sheet stretching machine is provided with hydraulically operated connecting rods for closing the clamping jaws onto the sheet metal. The rods transmit only compressive forces and are retracted after the tightening of the clamping jaws during stretching. Pulling cables serve to selectively open the clamping jaws.

7 Claims, 3 Drawing Figures

SHEET METAL CLAMPING APPARATUS

BACKGROUND OF THE INVENTION

The invention relates to a clamping device used in stretching metal sheets and plates. The clamping device is used in connection with a ductile metal sheet or plate straightening machine. The pulling heads of the clamping device are moved by a power drive. The pulling heads are equipped with a plurality of pairs of clamping jaws located across the width of the workpiece. The clamping jaws are guided by and slide over wedge-shaped, i.e., inclined surfaces of the pulling heads, and are slidable by the movement of hydraulic connecting rod-type devices between the projected out starting or initial clamping position and the retracted sheet metal release position.

DESCRIPTION OF THE PRIOR ART

In a known clamping device of this type, see German Pat. No. 1,602,467, the clamping jaws are connected, i.e., force-locked by hinged connecting rods and a cross member having a traverse rod, in which the traverse rod, itself, is connected to a piston rod of a hydraulic or pneumatic clamping jaw drive mechanism. This prior art apparatus allows the clamping jaws of all jaw pairs to start to work concurrently in successive clamping stages. The clamping jaws are located at all points across the width of the metal sheet sought to be straightened, such that plates or metal sheets having thickness variations or other surface irregularities or which are corrugated can be securely gripped, seized and straightened. The prior art apparatus is provided with a spring bumper between the traverse rod, connecting the connecting rods, and the clamping traverse. The spring bumper resiliently supports all of the clamping jaws, in both directions, such that, during the stretching process in the event of an accidental breakage of the metal sheet, the forces acting on the connecting rods are resiliently blocked from causing undesirable equipment damage.

What is, however, disadvantageous of the known prior art clamping apparatus is the fact that the forces released by the breaking of a metal sheet affect the connecting rods and their bearings since the spring bumper is located behind the movable connecting joints. Furthermore, the clamping of the workpiece, using the prior art device, requires two consecutively performed operating steps, namely, first projecting the clamping jaws into the clamping position, and then prestressing the spring bumper. This procedure is relatively time-consuming.

SUMMARY OF THE INVENTION

The object of the present invention is to provide an improved clamping apparatus, such that when a metal sheet or a plate does break, during the stretching process, the forces released will not, in any way, damage either the connecting rods which are used to activate the clamping jaws, the joints of the connecting rods, or the hydraulic (or pneumatic) drive. The present invention is extremely important since up-to-date ductile sheet metal straightening machines employ stretching forces greater than 5000 t, which forces are released in a sudden burst in the event of breakage of a sheet or plate, thereby resulting in immediate flinging back of the clamping jaws with great force.

The present invention solves the mentioned problem by using a simple and by virtue of its simple construction, reliable structural mechanism. The mechanical elements, which transmit the compression or gripping forces, enable the clamping jaws to slide into the starting clamping position. The mechanical elements are separated during the stretching process. Elements are also provided for selectively retracting the clamping jaws into the release position. The elements allow for relative movement (in the sense of an overriding motion) without impeding the movement of the clamping jaws in relation to direction of retraction of the elements.

As proposed by the present invention, two separate mechanical elements are used, which are essentially dependent on each other for performing (a) the projecting motion of the clamping jaws into the starting position and (b) the retracting motion of the clamping jaws to place them in the release position. The projection of the clamping jaws into the starting clamping position does, however, occur according to the invention, with the aid of elements which transmit compressive forces, preferably a pair of connecting rods. However, they only contact with the front side of their surfaces the corresponding counter-surfaces of the clamping jaws when the clamping jaws are initially adjusted. Otherwise, the connecting rod elements are not connected to the clamping jaws. It is therefore, possible to separate the elements from the clamping jaws by retracting them. The separation of the connecting rod elements which transmit the compressive forces, can occur after adjusting the clamping jaws and before the greatest forces, during the stretching process, are brought to bear on the workpiece. Should the workpiece break, and should the clamping jaws thereby be flung backwardly with great force, they will, according to the invention, not hit against the connecting rods but, rather, they will hit elements of the pulling head at the end of their traveling path, said elements being designed such that they withstand, without damage, a sudden powerful contact with the clamping jaws. The same can also be said for the elements which are provided for retracting the clamping jaws. These elements are designed such that if the metal sheet breaks, they are overtaken by the clamping jaws when the latter slam backwardly.

In a further development of the present invention, it is proposed that the clamping jaws be provided with an attachment piece rearwardly directed, on which the counter-surface is provided for contact with the front of the connecting rods.

According to the present invention, a pulling means, in the preferred embodiment, a pair of cables, serves to retract the clamping jaws into the release position. The cable, of course, also permits relative motion or overtaking motion of the clamping jaws in relation to the cable. The overtaking motion is thus unimpeded in the direction of the retraction of the jaws. In order for the retraction of the clamping jaws to be possible, with the least possible expenditure of force, the hydraulic drive, activating the cables, is arranged such that each cable adjusts into a position essentially parallel to the slope of the wedge or inclined surfaces of the pulling head, as the cable retracts the clamping jaws.

An arrangement particularly appropriate for the practical embodiment of the present invention has the connecting rods longitudinally divided at their frontal end, with their front engaging surfaces also longitudinally divided. As thus configured, the mounting equipment for the cable can be arranged in the space formed between the rods. In projecting the jaws, as well as in retracting the jaws, the relative forces are effective along the longitudinal center of the clamping jaws.

The invention is further detailed, with the aid of an exemplary embodiment illustrated in the drawings:

DETAILED DESCRIPTION OF THE DRAWINGS

Figure 1:
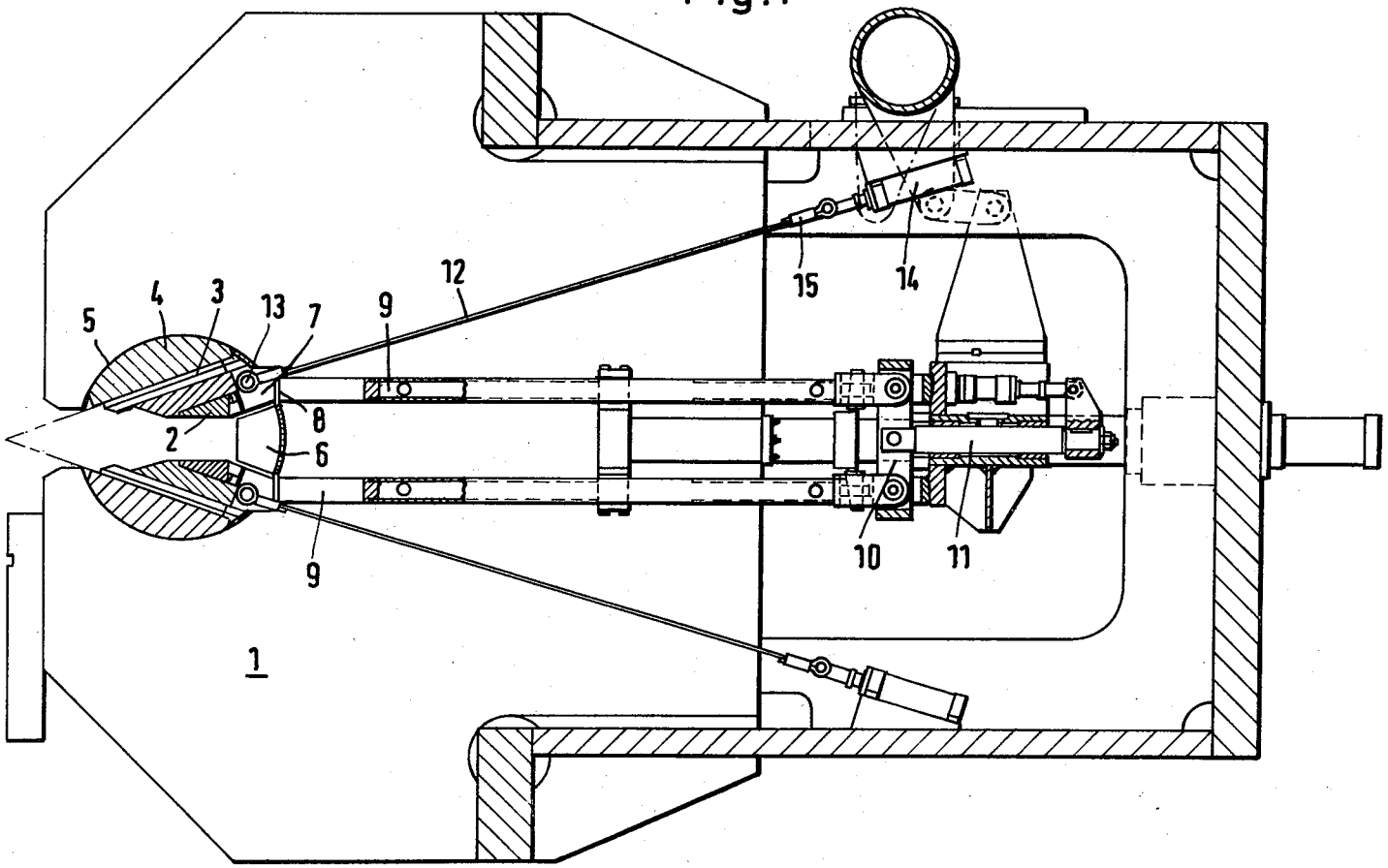
FIG. 1 is a vertical cross sectional view of a pulling head.

A plurality of clamping devices are arranged adjacent to each other. A single such clamping device comprises a pulling head 1, as illustrated in FIG. 1. A plurality of such clamping devices extend along the width of the sheet metal sought to be stretched. Said devices serve to support sheet metal as it is processed for stretching and for the removal of surface irregularities. The clamping jaws 2 are slidably guided and held within wedges 3. The wedges or inclined surfaces 3 are bordered by an insert piece 4 which is, itself, maintained in a mating recess 5 of pulling head 1. It will be appreciated that pulling head 1 represents a large, massive machine element. As FIG. 1 shows, the inclined surfaces 3 extend towards each other towards the front of pulling head 1, i.e., to the left in FIG. 1 and extend beyond the front end of clamping jaws 2.

A mechanical stop 6 is provided at the inner end of the space between the clamping jaws 2 in the recess 5. The purpose of stop 6 will be explained later. Each of the pair of clamping jaws 2 is equipped with an attachment piece 7, at the rear of which is located a planar contact surface 8. The front ends of the connecting rods 9 press against this contact surface 8 when the clamping jaws 2 are placed in the initial clamping position. The driving mechanism for the relative longitudinal motion of the connecting rods 9 is a piston-cylinder unit 11. The piston rod of unit 11 is connected, by a cross bar 10, to the connecting rods 9. The piston-cylinder unit 11 is double-acting such that it will retract the connecting rods 9 and release the rods 9 from the contact surfaces 8 after the stretching process has been started and the clamping jaws 2 are pressed against the workpiece by the stretching force itself.

Figure 3:
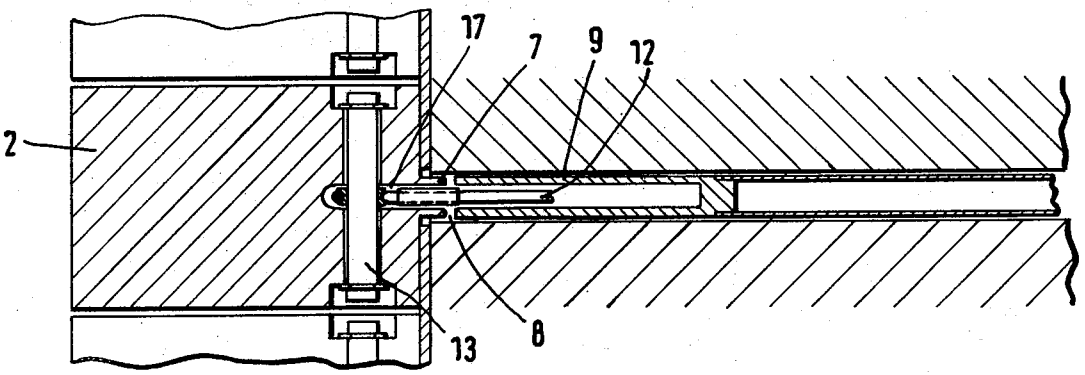
FIG. 3 is a cross sectional view of FIG. 2 taken along the lines indicated by the arrowheads.

Connected to the attachment piece 7 of the clamping jaws 2 are pulling cables 12, which are fastened to attachment piece 7 by pins 13 (see FIGS. 1 and 3). The cables 12 retract the clamping jaws 2 into an open position subsequent to the completion of the stretching process. A piston-cylinder unit 14 serves, for each cable 12, to operate the pulling cable 12, with the other end of the cable fastened to the piston rods of units 14 at 15.

Figure 2:
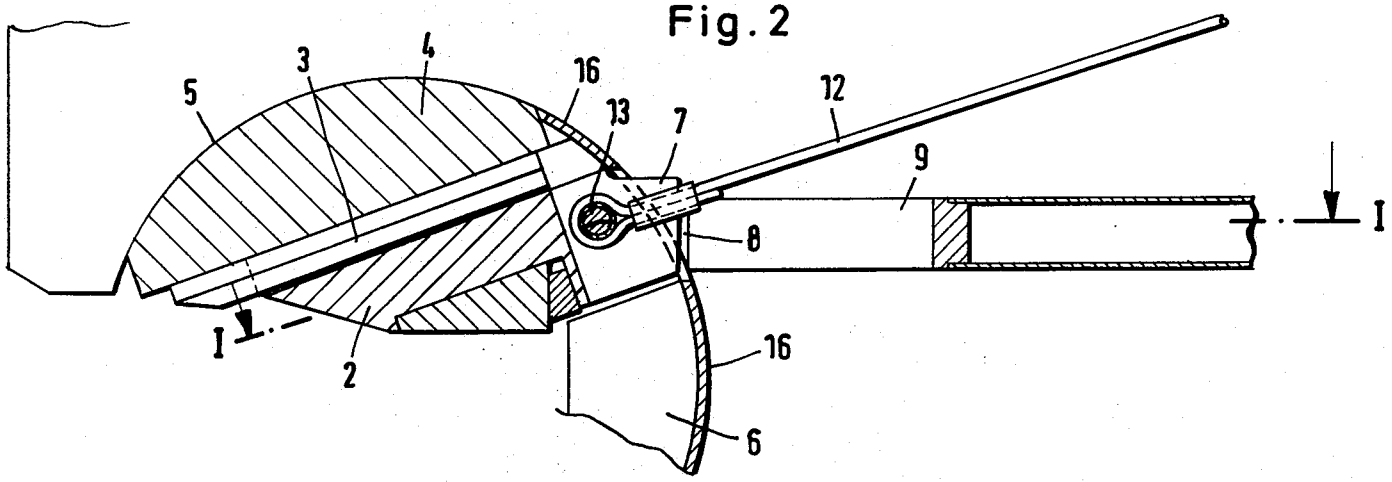
FIG. 2 is a partial enlarged section of FIG. 1 showing one side of the clamping jaw.

As can be seen from FIGS. 2 and 3, the attachment pieces 7, located at the rear of the clamping jaws 2, are longitudinally divided, such that a gap 17 is formed. A pin or bolt 13 passes transversely through the clamping jaw 2 and crosses gap 17, so that the cable 12 can be fastened to bolt 13. In order for the connecting rod 9 to centrally act on clamping jaws 2, the rods 9 are longitudinally divided in the area of their front ends. In this manner, they make full contact with the contact surfaces 8 arranged on both sides of the gap 17 of the attachment piece 7 of the clamping jaws 2.

FIGS. 2 and 3 illustrate the clamping jaws 2 in the extreme retracted position. The clamping jaws 2 protrude into the guide conduit with the attachment piece 7 directed toward the rear. The connecting rods 9 are movably arranged in the guide conduit. The clamping jaws 2 are arranged laterally to the opening of the guiding conduit, at the rear of recess 5 which is provided with armor plate 16. If a workpiece should break in the stretching process, the clamping jaws 2 will only slam back as far as the position illustrated in FIG. 2. The connecting rods have, after contact with surface 8, been shifted backwards while the clamping jaws 2, after seizing of the jaws, moves to the position shown in FIGS. 2 and 3. A gap thus exists between the frontal end of the connecting rod 9 and the counter-surface 8 of the attachment piece 7. Thus, the connecting rod 9 cannot be hit by the clamping jaw 2 as it slams back should the workpiece break during stretching. The cable 12, provided for opening the clamping jaws, is naturally, not at all impaired when the clamping jaw bounces back in the event of a workpiece breaking. The cable 12 merely loosens somewhat. The cable 12 exhibits its "cable-like" qualities, i.e., it can, at a given selected instant in time, without any intermediate mechanical operation being performed, retract the clamping jaws, yet upon the jaws slamming backwardly by the accidental, yet expected breakage of a metal workpiece, the cable will merely become limp, i.e., will not be permanently mechanically deformed by the large backward directed force and, thus, the cable is once again capable of selective retraction of the clamping jaws after the cables have been placed into the ready-for-stretching position by a forward movement of the compression rods. Since, upon breaking, the workpiece, itself, also slams into the recess 5 of the pulling head, a stop 6 is arranged at the bottom of the recess between the clamping jaws.

The clamping jaws may be opened, subsequent to the stretching process by retracting the cables 12. This motion is easily accomplished because the connecting rods 9 had previously been retracted, i.e., soon after the clamping jaws fully seize the workpiece at the start of the stretching process.

The teachings of the attached copy of the corresponding German Application, upon which this application claims priority, is herein specifically incorporated by reference.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A clamping device for use in a ductile sheet metal straightening machine, comprising:

(a) a pulling head capable of moving in a sheet metal straightening direction;

(b) said pulling head having an upper and lower clamping jaw;

(c) said clamping jaws guided by and sliding on surfaces of said pulling head inclined with respect to said sheet metal straightening direction;

(d) a pair of compression rods which, upon longitudinal movement in a direction opposite to said sheet metal straightening direction, move said clamping jaws along said inclined surfaces from a retracted position to a sheet metal clamping position;

(e) a hydraulic drive means connected to said compression rods for selective reciprocal longitudinal movement of said compression rods;

(f) said compression rods being selectively mechanically separable from said clamping jaws by said hydraulic drive means;

(g) pulling means for selectively retracting said clamping jaws, said pulling means being fixedly mechanically connected to said clamping jaws; and (h) said pulling means being cable-like.

2. An apparatus as claimed in claim 1, wherein:

(a) said clamping jaws are provided with counter surfaces; and (b) said compression rods are capable of contacting said counter surfaces.

3. An apparatus as claimed in claim 2, wherein:

(a) said clamping jaws are provided with an attachment piece located at the rear of said clamping jaws; and (b) said attachment piece is provided with said counter-surfaces.

4. An apparatus as claimed in claim 1, wherein:

(a) said pulling means is a cable.

5. An apparatus as claimed in claim 1, wherein:

(a) a hydraulic means is provided to activate said pulling means; and (b) said pulling means are maintained substantially parallel to said surfaces of said pulling head.

6. An apparatus as claimed in claim 3, wherein:

(a) said connecting rods are longitudinally divided at their frontal ends;

(b) said counter-surfaces are longitudinally divided; and (c) said pulling means are secured to said clamping jaws in the space formed between said divided connecting rods and counter-surfaces.

7. An apparatus as claimed in claim 6, wherein:

(a) a bolt passing through said space, secures said pulling means to said clamping jaws.

* * * * *